United States Patent [19]

Harrison

[11] Patent Number: 4,780,919

[45] Date of Patent: Nov. 1, 1988

[54] HOSPITAL BED

[76] Inventor: Mildred B. Harrison, 198 Cedar Rd., East Northport, N.Y. 11731

[21] Appl. No.: 110,448

[22] Filed: Oct. 20, 1987

[51] Int. Cl.[4] ..... A61G 7/02; A47B 23/00

[52] U.S. Cl. ..... 5/60; 5/90; 5/308; 5/507; 5/508

[58] Field of Search ..... 5/507, 508, 503, 90, 5/308, 58, 60, 2 R; 108/49

[56] References Cited

U.S. PATENT DOCUMENTS

| | | | |
|---|---|---|---|
| 1,359,623 | 11/1920 | Sadlik | 5/507 |
| 1,440,906 | 1/1923 | Bouza | 5/507 |
| 1,525,605 | 2/1925 | Dry | 5/90 |
| 2,174,582 | 10/1939 | Hudon | 5/308 |
| 3,535,720 | 10/1970 | Woods | 5/507 |
| 3,618,145 | 4/1971 | Rowe | 5/507 |
| 3,854,155 | 12/1974 | Picard | 5/507 |
| 4,680,796 | 7/1987 | Packard et al. | 5/60 |

FOREIGN PATENT DOCUMENTS

| | | | |
|---|---|---|---|
| 812671 | 5/1937 | France | 108/49 |
| 484472 | 9/1953 | Italy | 5/507 |

*Primary Examiner*—Alexander Grosz
*Attorney, Agent, or Firm*—Jerry T. Kearns

[57] ABSTRACT

A hospital bed has a table which moves on a slide rail along the length of the bed. The movement of the table is controlled by a motorized lead screw. The table is mounted on a pivotal support so that when not in use, it may be folded into a storage position. The hospital bed is also provided with a motorized storage drawer and a motorized sanitary unit mounted on the bed frame, beneath the mattress. A remote control unit at the headboard of the bed controls the operation of the drawer, a lamp, the sanitary unit and the table.

2 Claims, 2 Drawing Sheets

HOSPITAL BED

BACKGROUND OF THE INVENTION

1. Field of the Invention

The present invention relates to hospital beds, and more particularly pertains to a new and improved hospital bed with a motorized table, motorized storage drawer and motorized sanitary unit which are connected for operation by a remote control unit mounted at the headboard of the bed. The commonly used type of hospital bed is provided with a remote controlled motorized adjustment mechanism for raising and lowering the head and foot sections of the bed. Tray tables utilized with the conventional type of hospital beds are manually movable and are generally mounted on a separate support detached from the bed. A typical hospital bed is not provided with sanitary facilities suitable for use by severely sick or injured patients and these typical beds also do not provided adequate storage facilities for the personal effects of the hospital patient. In order to overcome the aforesaid disadvantages associated with the conventional type of hospital bed, the present invention provides a new and improved hospital bed provided with a motorized, remote controlled, storage unit, sanitary unit and table.

2. Description of the Prior Art

Various types of hospital beds are known in the prior art. A typical example of such a hospital bed is to be found in U.S. Pat. No. 3,334,951, which issued to J. Douglass Jr. et al on Aug. 8, 1967. This patent discloses an examing table which has a motorized mechanism for elevating various sections of the bed. Manually operable storage drawers are provided on side portions of the examining table. U.S. Pat. No. 3,503,083, which issued to F. Barnett on Mar. 31, 1970, discloses a hospital bed which utilizes a power operated mechanism to adjust the bed into a position in which an invalid in the bed will be moved to a sitting up position. The bed has toilet facilities contained therein for the use of the patient without the necessity to leave the bed. U.S. Pat. No. 3,757,355, which issued to R. Allen et al on Sept. 11, 1973, discloses a system for collecting the body waste materials excreted by a person confined to a hospital bed. The system includes a cart which cooperates with an aperture in the mattress of the bed to collect and dispose of the waste materials of a patient on the mattress. U.S. Pat. No. 3,959,833, which issued to W. Burke on June 1, 1976, discloses a combination mattress and toilet facility for use with a hospital bed. A receptable for receiving and storing body waste is mounted within the mattress. U.S. Pat. No. 4,152,792, which issued to G. Glintz on May 8, 1979, discloses a toiletry and bath basin with disposable liners for use with a hospital bed. This device allows patients confined to a bed to be conveniently bathed. U.S. Pat. No. 4,190,913, which issued to P. DiMatteo et al on Mar. 4, 1980, discloses a combined hospital bed and toilet facility which allows patients confined to their beds to use the toilet without leaving their beds or to be placed in a wheel chair. A sectionalized mattress is positioned in sequential steps so as to place the patient directly over a toilet or in a wheel chair without discomfort to the patient. A section of the mattress is then removed to allow access to the toilet disposed there beneath. U.S. Pat. No. 4,590,632, which issued to B. Meyer on May 27, 1986, discloses a mattress having a recess for the reception of a bedpan.

While the above mentioned devices are suited for their intended usage, none of these devices provide a hospital bed having sanitary facilities disposed in a remote controlled motorized drawer beneath the bed mattress. Additionally, none of the aforesaid devices disclose a hospital bed provided with a motorized remote controlled storage drawer, tray table and lamp. Another feature of the present invention, not contemplated by the aforesaid prior art devices, is the provision of a hospital bed having a tray table mounted for longitudinal movement on a remote controlled motorized lead screw and pivotal to a storage position when not in use. Inasmuch as the art is relatively crowded with respect to these various types of hospital beds, it can be appreciated that there is a continuing need for the interest in improvements to such hospital beds, and in this respect, the present invention addresses this need and interest.

SUMMARY OF THE INVENTION

In view of the foregoing disadvantages inherent in the known types of hospital beds now present in the prior art, the present invention provides an improved hospital bed. As such, the general purpose of the present invention, which will be described subsequently in greater detail, is to provide a new and improved hospital bed which has all the advantages of the prior art hospital beds and none of the disadvantages.

To attain this, a representative embodiment of the concepts of the present invention is illustrated in the drawings and makes use of a bed frame having a slide rail disposed at a lower side portion and having a parallel extending motorized lead screw. A tray table is mounted on a pivotal standard on a lead nut and slide element for remote controlled movement along the length of the bed. Additional features of the present invention include the provision of motorized rack and pinion actuated storage drawer and sanitary unit disposed beneath the mattress at an opposite side of the bed frame. Control of these devices is achieved by a remote control unit mounted on the head board of the bed. The hospital bed is a complete unit, thus there is no need for other furniture in the room.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limited as to the scope of the invention in any way.

It is therefore an object of the present invention to provide a new and improved hospital bed which has all the advantages of the prior art hospital beds and none of the disadvantages.

It is another object of the present invention to provide a new and improved hospital bed which may be easily and efficiently manufactured and marketed.

It is a further object of the present invention to provide a new and improved hospital bed which is of a durable and reliable construction.

An even further object of the present invention is to provide a new and improved hospital bed which is susceptible of a low cost of manufacture with regard to both materials and labor, and which accordingly is then susceptible of low prices of sale to the consuming public, thereby making such hospital beds economically available to the buying public.

Still yet another object of the present invention is to provide a new and improved hospital bed which provides in the apparatuses and methods of the prior art some of the advantages thereof, while simultaneously overcoming some of the disadvantages normally associated therewith.

Still another object of the present invention is to provide a new and improved hospital bed which has a remote controlled motorized tray table mounted for movement along the length of the bed and pivotal to a storage position when not in use.

Yet another object of the present invention is to provide a new and improved hospital bed which has a sanitary unit movable between an open operative position and a closed storage position beneath the mattress of the body by remote control.

Even still another object of the present invention is to provide a new and improved hospital bed which has a storage drawer disposed beneath the mattress mounted for remote controlled movement between opened and closed positions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
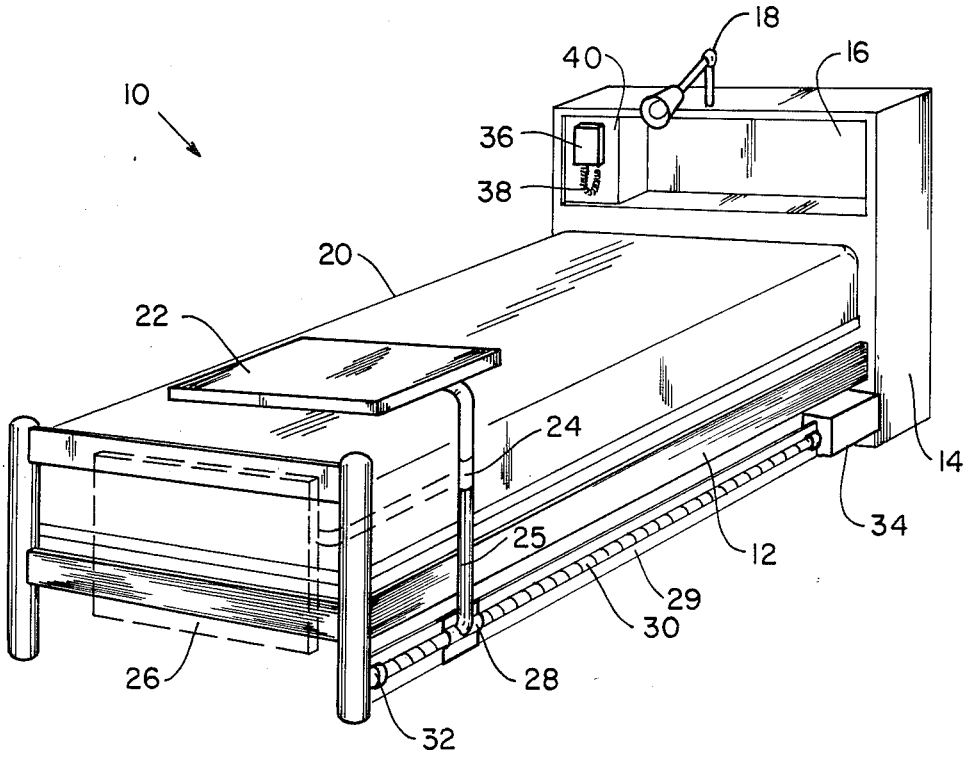
FIG. 1 is a perspective view of the hospital bed of the present invention.

With reference now to the drawings, and in particular to FIG. 1 thereof, a new and improved hospital bed embodying the principles and concepts of the present invention and generally designated by the reference numeral 10 will be described.

More specifically, it will be noted that the first embodiment 10 of the invention includes a bed frame 12 having a head board 14 provided with a storage shelf space 16. A lamp 18 is mounted for manual pivotal adjustment on top of the head board 14. The hospital bed 10 of the present invention includes a mattress 20 and a tray table 22 which is mounted for linear movement along the length of the mattress 20. A slidable collar 24 serves to lock a conventional pivotal connection on the tray table standard 25. The tray table standard 25 is mounted on a lead nut slide element 28 which is in engagement with a rotatable lead screw 30 and a slide rail 29. The lead screw 30 is mounted for rotation in a bearing block 32 by a conventional bidirectional electric motor 34. By actuating the motor 34, the tray table 22 may be moved along the lead nut 30 and slide rail 29 to any desired position along the length of the mattress 20. When it is desired to store the tray table 22, it is moved to the foot of the bed and manually pivoted to a storage position illustrated in dotted lines at 26. A remote control 36 is connected by a telephone type cord to a control box 40 mounted in the head board 14 of the bed 10 of the present invention. The control box 40 and control unit 36 contain conventional switches for actuation of the motor 34, the lamp 18 and for motors which actuate a storage drawer and sanitation unit to be subsequently described. The control box 40 contains conventional electrical connections and utilizes 120 volt AC electric current. A step down transformer may be utilized to reduce the voltage to 24 volts DC for the actuation of the remote control unit 36 and the various motors. This minimizes the hazard of electrical shock to a patient in the bed.

Figure 2:
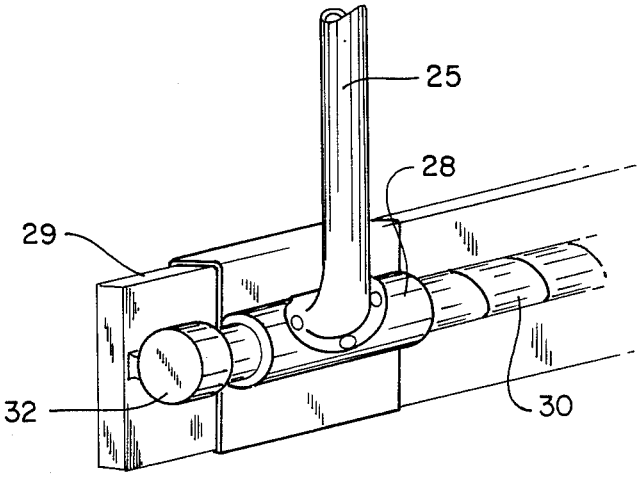
FIG. 2 is a perspective detail view of the tray table movement mechanism.

With reference now to FIG. 2, the details of the mounting of the tray table standard 25 for linear movement along the mattress 20 is provided. A slide rail 29 is provided with a rotational bearing block 32 which mounts a conventional lead screw 30 for rotation. The slide rail 29 is securely fastened to a portion of the bed frame 12. The tray table standard 25 includes a cooperating guide element 28 which engages the slide rail 29 and is provided with an internal thread for the engagement of the lead screw 30. Thus, when the lead screw 30 is rotated by the reversible motor 34, it may be reciprocated along the length of the slide rail 29. Conventional limit switches wired to the control box 40 may be positioned on the slide rail 29 to stop the motor 34 when the table guide element 28 reaches the end of travel.

Figure 3:
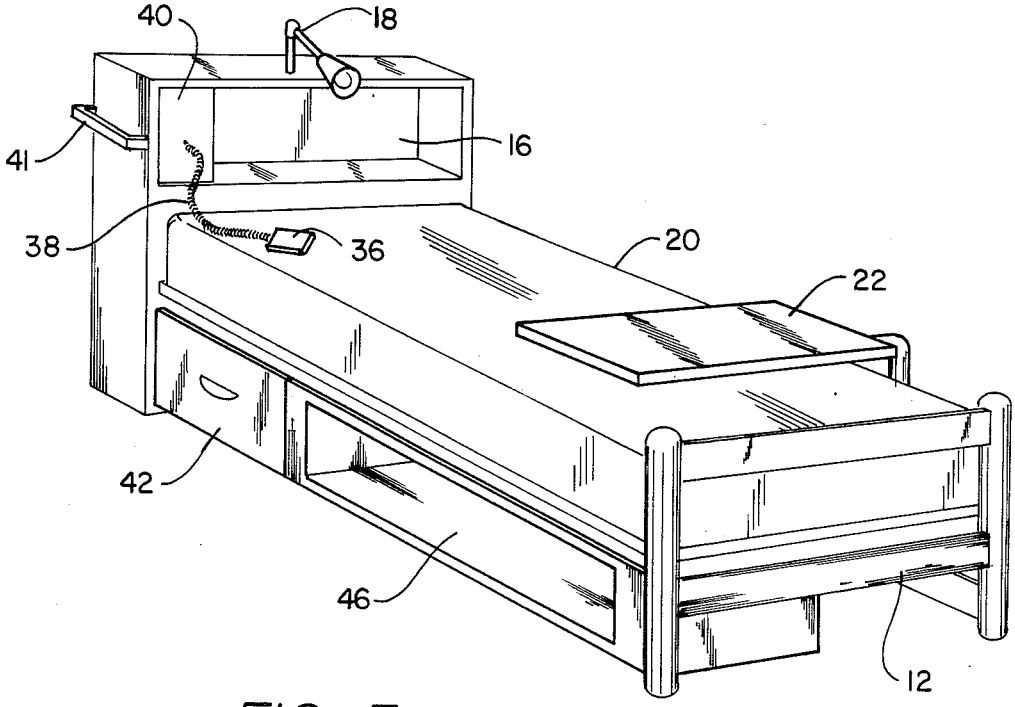
FIG. 3 is a perspective view of the hospital bed of the present invention illustrating the storage drawer and sanitary unit receptacle.

With reference now to FIG. 3, it may be seen that a storage drawer 42 and a receptacle 46 for a sanitary unit are disposed at a side of the bed opposite the tray table 22 movement mechanism. The storage drawer 42 and sanitary unit receptacle 46 are mounted beneath the mattress 20. Controls for moving the storage drawer 42 and sanitary unit out of the receptacle 46 are contained within the control box 40 and switches for the actuation thereof are received on the remote control unit 36. A towel rack 41 is mounted on the headboard 14.

Figure 4:
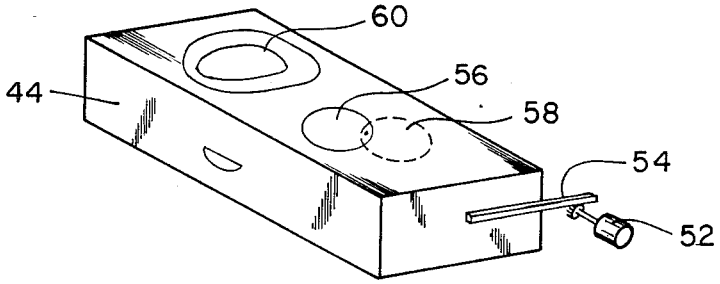
FIG. 4 is a perspective detail view of the sanitary unit of the hospital bed of the present invention.

As shown in FIG. 4, the sanitary unit 44 is provided with a conventional toilet seat 60 and a receptacle 56 for the collection and storage of waste paper. The waste paper receptacle 56 is provided with a pivotal cover 58. The sanitary unit 44 is mounted for reciprocating movement into and out of the receptacle 46 by a bidirectional motor 52 driving a pinion in engagement with a rack bar 54 secured to an external side wall of the sanitary unit 44. Limit switches connected to the control box 40 may be utilized to deactuate the motor 52 when the sanitary unit 44 reaches a fully open or closed position. These limit switches may be mounted on the bed frame and be actuated by contact with the ends of the rack bar 54.

Figure 5:
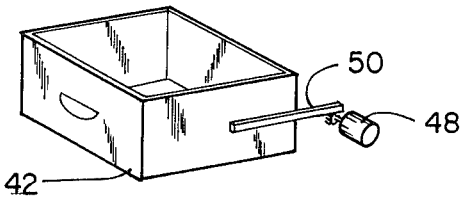
FIG. 5 is a perspective detail view of the storage drawer and operating mechanism of the hospital bed of the present invention.

With reference now to FIG. 5, it will be seen that the storage drawer 42 is provided with a bidirectional motor 48 driving a pinion in engagement with a rack bar 50 secured to one exterior side wall of the storage unit. Conventional limit switches may also be utilized to deactuate the motor 48 at the extreme travel positions of the rack bar 50.

As will now be readily understood, by actuation of the bidirectional motors 48, 52, and 34, the storage drawer 42, sanitary unit 44 and tray table 22 may be moved between operative and inoperative positions as desired by the patient. It should be understood that the hospital bed of the present invention is also provided with conventional elevational mechanisms for elevating the head and foot portions of the mattress 20. Controls for these conventional mechanisms may also be provided on the remote control unit 36. It will now be understood that by elevating the head section of the mattress 20 and actuating the sanitary unit control motor 52 to extend the sanitary unit 44 outwardly of the receptacle 46 from beneath the mattress 20, a patient may easily access the toilet facility 60 as well as the waste paper receptacle 56.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principle of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved hospital bed, comprising:

a frame;

a mattress supported on said frame;

a head board having a storage shelf mounted on said frame;

a lamp mounted on said head board;

a longitudinally extending slide rail mounted at a lower side portion of said frame;

a rotatably mounted lead screw extending parallel to said slide rail;

a guide element having a lead nut engaging said lead screw and a portion engaging said slide rail for sliding movement thereon;

a bidirectional motor for rotating said lead screw;

a standard rigidly connected to said guide element;

a tray table pivotally connected to said standard for movement between an operative and a storage position;

a storage drawer mounted beneath said mattress on a side of said frame opposite said slide rail;

a rack bar secured to an exterior side wall of said storage drawer;

a pinion engaging said rack bar;

a bidirectional motor connected for rotating said pinion;

a sanitary unit including a toilet mounted beneath said mattress adjacent said storage drawer;

a rack bar secured to an exterior side wall of said sanitary unit;

a pinion engaging said sanitary unit rack bar;

a bidirectional motor connected for rotating said pinion; and remote control means on said head board for selectively actuating said lamp, said tray table, said storage drawer and said sanitary unit.

2. A new improved hospital bed, comprising:

a frame;

a mattress supported on said frame;

a longitudinally extending slide rail mounted at a lower side portion of said frame;

a rotatably mounted lead screw extending parallel to said slide rail;

a guide element having a lead nut engaging said lead screw and a portion engaging said slide rail for sliding movement thereon;

a bidirectional motor for rotating said lead screw;

a standard rigidly connected to said guide element;

a tray table pivotally connected to said standard for movement between an operative and a storage position;

a storage drawer mounted beneath said mattress on a side of said frame opposite said slide rail;

a rack bar secured to an exterior side wall of said storage drawer;

a pinion engaging said rack bar;

a bidirectional motor connected for rotating said pinion;

a sanitary unit including a toilet mounted beneath said mattress adjacent said storage drawer;

a rack bar secured to an exterior side wall of said sanitary unit;

a pinion engaging said sanitary unit rack bar;

a bidirectional motor connected for rotating said pinion; and remote control means for selectively actuating said tray table, said storage drawer and said sanitary unit.

* * * * *